US009750332B2

(12) United States Patent
Botticello

(10) Patent No.: US 9,750,332 B2
(45) Date of Patent: Sep. 5, 2017

(54) FLEXIBLE BELT MOUNTED ELECTRONIC DEVICE HOLDING ARM

(71) Applicant: Debra M Botticello, Greenwich, CT (US)

(72) Inventor: Debra M Botticello, Greenwich, CT (US)

( * ) Notice: Subject to any disclaimer, the term of this patent is extended or adjusted under 35 U.S.C. 154(b) by 47 days.

(21) Appl. No.: 14/957,764

(22) Filed: Dec. 3, 2015

(65) Prior Publication Data

US 2017/0156480 A1 Jun. 8, 2017

(51) Int. Cl.
*A45F 5/02* (2006.01)

(52) U.S. Cl.
CPC ..... *A45F 5/021* (2013.01); *A45F 2200/0516* (2013.01); *Y10S 224/93* (2013.01)

(58) Field of Classification Search
CPC ..... A45F 5/021; A45F 2200/0516; A45F 2200/0525; A45F 2200/0508; A45F 2200/0533; Y10S 224/93; H04M 1/0279
USPC ..... 224/660, 662, 930; D3/218
See application file for complete search history.

(56) References Cited

U.S. PATENT DOCUMENTS 6,137,675 A * 10/2000 Perkins ..... G06F 1/163 128/876
9,405,172 B2 * 8/2016 Cunningham, III ... F16M 13/04
9,510,662 B1 * 12/2016 Bruns ..... A45F 5/021
2007/0000964 A1 * 1/2007 Howell ..... A45C 7/0086 224/637
2008/0173685 A1 * 7/2008 Welker ..... A01M 31/00 224/576
2009/0032420 A1 * 2/2009 Zenzai ..... G03B 17/08 206/316.2
2013/0234644 A1 * 9/2013 Weeks ..... H02J 7/0045 320/101
2014/0342785 A1 * 11/2014 Saldo ..... H04M 1/04 455/575.6
2015/0223590 A1 * 8/2015 Arias-Tabima ..... A45F 5/021 224/195
2015/0237997 A1 * 8/2015 Bruns ..... A45F 5/02 224/191
2015/0296976 A1 * 10/2015 Janowski ..... G06F 1/16 108/43
2016/0049983 A1 * 2/2016 Ripka ..... H04B 1/385 455/575.6
2016/0182698 A1 * 6/2016 Gordon ..... H04M 1/04 455/575.6
2016/0198836 A1 * 7/2016 Fan ..... A45F 5/00 224/271

* cited by examiner

*Primary Examiner* — Scott McNurlen

(57) ABSTRACT

The system of the preferred embodiments is a electronic device holding arm including a belt that can be releasably attached around the torso of a user; and a flexible arm attached on one end to the belt; a clamp attached to the distal end of the flexible arm, where the clamp is designed to hold a mobile electronic device. The mobile electronic device holding arm is designed to fasten around a user's torso and support a mobile electronic device in a position that it can be viewed and used by the user without the user having to use their hands to support the device.

12 Claims, 2 Drawing Sheets

FLEXIBLE BELT MOUNTED ELECTRONIC DEVICE HOLDING ARM

BRIEF DESCRIPTION OF THE FIGURES

FIG. 4 is a schematic representation of the system of the preferred embodiments, where the flexible arm is a gooseneck constructed from a series of components held in tension, where the flexible arm is further attached tangentially to the length of the belt for at least 4 inches of its length, where a flexible polymer sheet is attached to the belt to provide rigidity perpendicular to the belt, where the flexible polymer sheet is mounted to the belt at the same portion of the belt's length that the end of the flexible arm is attached to.

DESCRIPTION OF THE PREFERRED EMBODIMENTS

The following description of the preferred embodiments of the invention is intended to enable someone skilled in the prior art to make and use this invention, but is not intended to limit the invention to these preferred embodiments.

1. First Preferred Embodiment

Figure 1:
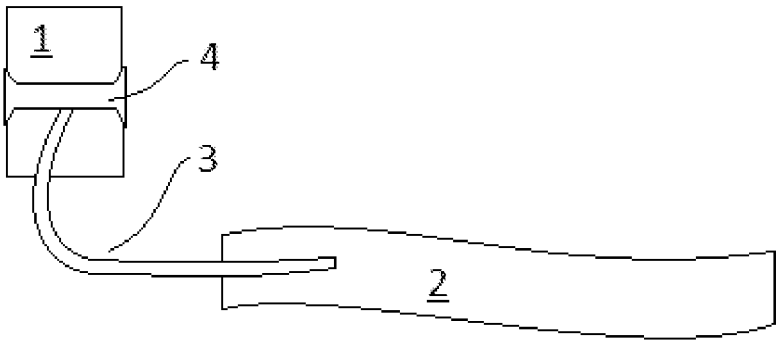
FIG. 1 is a schematic representation of the system of the preferred embodiments, where a mobile electronic device is releasably mounted to the clamp.

As shown in FIG. 1, the system of the preferred embodiments is a electronic device 1 holding arm including a belt 2 that can be releasably attached around the torso of a user; and a flexible arm 3 attached on one end to the belt 2; a clamp 4 attached to the distal end of the flexible arm 3, where the clamp 4 is designed to hold a mobile electronic device 1. The mobile electronic device 1 holding arm is designed to fasten around a user's torso and support a mobile electronic device 1 in a position that it can be viewed and used by the user 19 without the user 19 having to use their hands to support the device.

Figure 4:
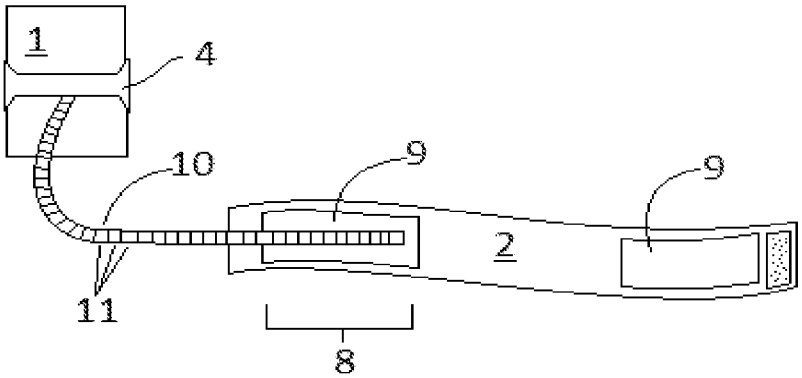
Figure 5:
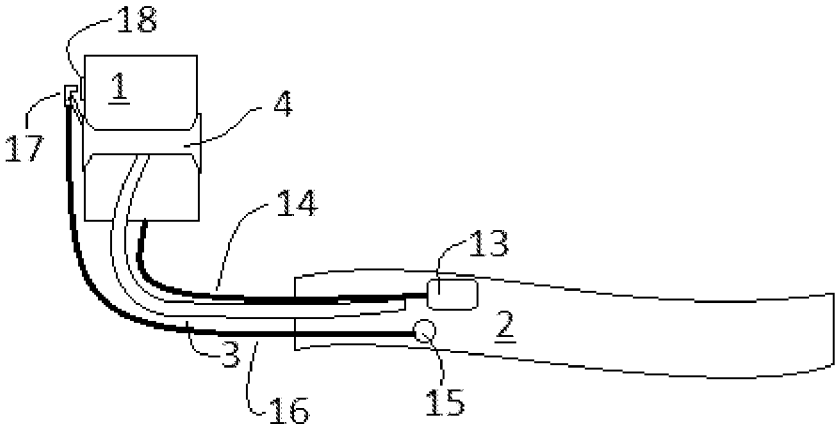
FIG. 5 is a schematic representation of the system of the preferred embodiments, where at least one of a button and a lever 15 allows the user 19 to actuate a mechanism that presses at least one button on the mobile electronic device, and where the belt further includes a battery attached to at least one of the belt and the clamp, where wires connect the battery to the charging port of the mobile electronic device.

As shown in FIG. 1, the electronic device 1 holding arm includes a flexible arm 3 attached to a belt 2. As shown in FIG. 4, the flexible arm 3 is preferably a gooseneck flexible arm 10 including a series of members 11 held in tension, with the members 11 having friction at their joints that holds the arm in position while also allowing repositioning. In another preferred variation, the flexible arm 3 can be a modular design similar to a Gorillapod tripod known in prior art, as seen in U.S. Pat. No. 7,891,615. In another preferred variation, the flexible arm 3 may have a spiral wound steel construction. In another preferred variation, the flexible arm 3 may have a jointed construction with rigid members coupled via pivoting joints held in position by friction. The flexible arm 3 may, however, have any suitable construction.

Figure 2:
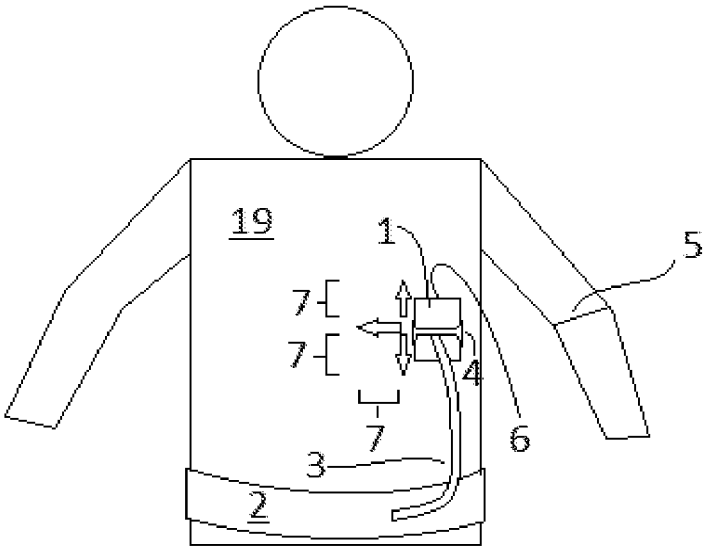
FIG. 2 is a schematic representation of the system of the preferred embodiments releasably mounted to a user's waist, where the mobile electronic device is supported in a position at least as high as the user's elbow.

As shown in FIG. 2, the belt 2 is adapted to releasably attach around the torso of a user. The flexible arm 3 can then be bent to support the mobile electronic device 1 in a desired position. As shown in FIG. 4, in one preferred variation the belt 2 releasably attaches around the user's torso using a hook and loop fastener. In another preferred variation, the belt 2 releasably attaches around the user's torso using a snap buckle connector. In another preferred variation, the belt 2 releasably attaches around the user's torso using a buckle with perforations in the opposite end of the belt 2. The belt 2 may, however, releasably attach around the torso of the user 19 in any suitable manner.

Figure 3:
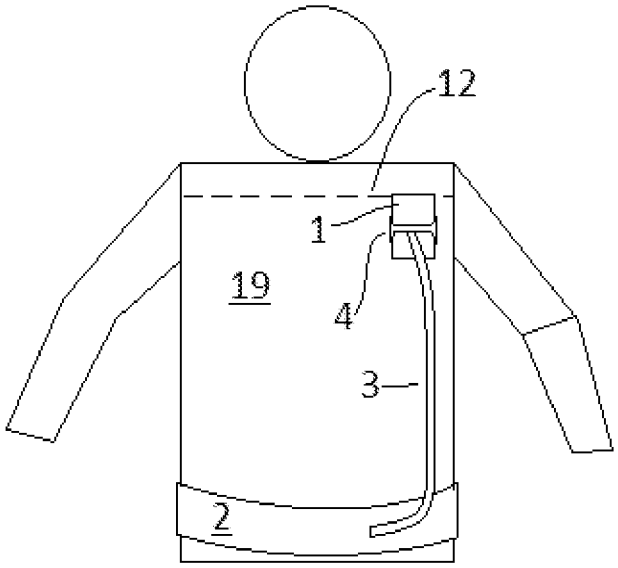
FIG. 3 is a schematic representation of the system of the preferred embodiments releasably mounted to a user's waist, where the mobile electronic device is supported in a position with the screen facing the user 19 and the top of the mobile electronic device at least as high as the user's collarbone.

As shown in FIG. 2, the flexible arm 3 is preferably long enough and designed such that the mobile electronic device 1 can be supported at a level at least as high as the user's elbows 5. As shown in FIG. 3, in another preferred variation the flexible arm 3 is long enough and designed such that the mobile electronic device 1 can be supported at a level at least as high as the user's collarbone 12. The flexible arm 3 may, however, be of a length and design intended to support the mobile electronic device 1 at any suitable height. The flexible arm 3 is preferably stiff enough and strong enough to support a mobile electronic device 1 in a viewing position, including but not limited to the positions described above, without bending the flexible arm 3 at rest with a mobile electronic device 1 weighing at least 3 ounces attached to the clamp 4. In another preferred variation, the flexible arm 3 is stiff enough and strong enough to support a mobile electronic device 1 in a viewing position, including but not limited to the positions described above, without bending the flexible arm 3 at rest with a mobile electronic device 1 weighing at least 6 ounces attached to the clamp 4. In a preferred variation, the flexible arm 3 is preferably stiff enough and strong enough to support a mobile electronic device 1 in a viewing position, including but not limited to the positions described above, without allowing a mobile electronic device 1 weighing at least 3 ounces to move more than six inches 7 in any direction relative to the user 19 as the user 19 walks at a normal pace. In this preferred variation, the attachment between the belt 2 and the flexible arm 3 is also stiff enough and strong enough to support a mobile electronic device 1 in a viewing position, including but not limited to the positions described above, without allowing a mobile electronic device 1 weighing at least 3 ounces to move more than six inches 7 in any direction relative to the user 19 as the user 19 walks at a normal pace.

As shown in FIG. 4, in one preferred variation at least one section of flexible polymer sheet 9 is attached to the belt 2. The attachment is preferably made by one or more of A) sewing, B) adhesive, C) plastic welding, and D) riveting. The attachment may, however, be made by any suitable means. The polymer sheet 9 is preferably flexible in the direction of its long axis, tangential to the belt 2 when worn, but stiff in the axis perpendicular to the belt 2. The flexible polymer sheet 9 is preferably attached to the belt 2 at least where the end of the flexible arm 3 is also attached to the belt 2. This preferably provides a secure and stiff backing to the mounting of the flexible arm 3, providing stability and stiffness to the flexible arm 3. In one variation, an additional polymer sheet 9 may be attached to the opposing end of the belt 2. In another variation, the entire belt 2 may have a flexible polymer sheet 9 attached to it. There may, however, be no flexible polymer sheet 9 attached to the belt 2. The flexible polymer sheet 9 is preferably made of a material including high density polyethylene (HDPE) sheet, nylon sheet, and polypropylene sheet. In another variation, the sheet may be made of urethane or any other suitable polymer. In another polymer, a stiff section of leather may be attached to the belt 2. In another variation, the belt 2 may be made of a stiff leather material. In another variation, there may be no sheet and another means of stiffening the belt 2 in the direction perpendicular to the long axis of the belt 2 may be used. In this variation, polymer ribs may be attached to the belt 2, running perpendicular to the belt 2. In another variation, metal ribs may be attached to the belt 2 to stiffen the belt 2. There may, however, be any suitable means of stiffening the belt 2 in the direction perpendicular to the long axis of the belt 2. There may, however, be no means for stiffening the belt 2 whatsoever.

In one preferred variation, the belt 2 may be made of an elastic fabric capable of stretching. In another preferred variation, the belt 2 may be made of nylon webbing material. In another preferred variation, the belt 2 may be made out of a natural fiber, which can include but is not limited to cotton and wool. In another preferred variation, the belt 2 may be made of leather. The belt 2 may, however, be made of any suitable material.

The flexible arm 3 is preferably attached to the belt 2 by sewing a length of material over the end of the flexible arm 3 and to the belt 2. Preferably loops of thread or other suitable material are passed through the belt 2 and around the flexible arm 3 along the attachment area to prevent the flexible arm 3 from sliding out of the sewn fabric pocket. In an alternative variation, adhesives are used to attach the flexible arm 3 to the belt 2. In another variation, at least one of metal bands and metal wires are passed through the belt 2 and around the flexible arm 3 to strengthen the attachment to the belt 2. In another preferred variation, the flexible arm 3 is attached to the polymer sheet 9 by adhesive. In another preferred variation, the polymer sheet 9 is molded to have at least one of rings of polymer and an integral polymer passageway into which the flexible arm 3 may be inserted and attached. In this preferred variation, at least one of adhesives and threaded fasteners are used to secure the flexible arm 3 to the molded polymer mounting sheet. The flexible arm 3 may, however, be mounted via any suitable means to the belt 2. Preferably at least 2 inches of the flexible arm 3 is attached to the belt 2 and prevented from significant movement or separation relative to the attachment section of the belt 2. This preferably provides a strong, stiff mounting section of the flexible arm 3, enhancing the load holding ability and stability of the flexible arm 3. In another variation, at least four inches 8 of the flexible arm 3 is attached to the belt 2 and prevented from significant movement or separation relative to the attachment section of the belt 2. The flexible arm 3 may, however, be attached to the belt 2 with any suitable length of interface at the point of attachment. The flexible arm 3 may, however, be attached to the belt 2 in any suitable manner.

As shown in FIG. 1, the clamp 4 that holds the mobile electronic device 1 is mounted to the distal end of the flexible arm 3. In one preferred variation, the clamp 4 is a molded polymer piece adapted to hold a mobile device using friction. In another preferred variation, the clamp 4 is a molded polymer piece adapted to clip around the mobile electronic device 1 and hold it via one or more of clips and snap retainers. In another preferred variation, the clamp 4 is made of metal. The clamp 4 may, however, be made of any suitable material with any suitable design. The clamp 4 is designed to hold the mobile electronic device 1 securely on the end of the flexible arm 3 such that the mobile electronic device 1 can be positioned with the screen 6 in easy view of the eyes of the user 19 and at an angle and position convenient for use of the mobile electronic device 1 by the user. The clamp 4 may, however, have any suitable design.

In one preferred variation, at least one of a button 15 and a lever 15 may be included on one or more of the belt 2 and the flexible arm 3. The at least one of a button 15 and a lever 15 connects at least one of mechanically and electrically to an actuator 18 designed to press at least one button 18 on the mobile phone device. In one variation, at least one of a cable 16 and a thin rod 16 is slidably coupled to the flexible arm 3 and actuates a mechanical actuator 18 that is designed to press at least one button 18 on the mobile electronic device 1. In one variation, the mechanical actuator 18 is a small fulcrum arm attached to a pivot, where the at least one of a rod 16 and a cable 16 applies force to the fulcrum arm such that it pivots with enough force to actuate at least one button 18 on a mobile electronic device 1. The mechanical actuator 18 is preferably attached to the clamp 4. In a second variation, an electromechanical actuator 18 is attached to the clamp 4 and a button 15 is attached to at least one of the belt 2 and the flexible arm 3, where the button 15 completes a circuit between a battery attached to at least one of the belt 2 and the clamp 4, wires connected to the button 15, and the electromechanical actuator 18, where the electromechanical actuator 18 is designed to press at least one button 18 on the mobile electronic device 1. In one preferred variation, this allows the user 19 to actuate at least one button 18 on the mobile electronic device 1 necessary for actuating a camera on the mobile electronic device 1 to take a picture. There may, however, be any set of features necessary to actuate at least one button 18 on a mobile electronic device 1. The at least one button 18 on the mobile electronic device 1 may, however, be actuated for any suitable reason. There may, however, be no means for actuating at least one button on a mobile electronic device 1.

In a preferred variation, there may be a battery 13 included in at least one of the clamp 4 and the belt 2. In a preferred variation, the battery 13 is electrically connected to a wire 14 running to a charging connection that may be coupled to the mobile electronic device 1, where the battery 13 is designed to provide electrical charge to the mobile electronic device 1. In a preferred variation, the battery 13 may be removably attached to at least one of the belt 2 and the clamp 4, so that the user 19 may remove the battery 13. In another variation, this removable battery 13 allows the user 19 to interchange charged batteries, which provides the user 19 a means to carry multiple batteries to provide a means to keep the mobile electronic device 1 charged for a longer period of time. In another preferred variation, the belt 2 includes at least one of a charging cable designed to interface with the mobile electronic device 1, and a wireless charging accessory capable of electrically connecting to the mobile electronic device 1 to provide an electrical charge to it. The system of the preferred embodiments may, however, include no components for providing a charge to a mobile electronic device 1.

In another preferred variation, the belt 2 further includes at least one pocket on the belt 2. The pocket may include at least one of a zipper and a hook and loop fastener to close the pocket. In this preferred variation, the pocket is designed to carry any items the user 19 may want to transport. The belt 2 may, however, include no pocket at all.

As a person skilled in the art will recognize from the previous detailed description and from the figures and claims, modifications and changes can be made to the preferred embodiments of the invention without departing from the scope of this invention defined in the following claims.

I claim:

1. An electronic device holding arm comprising a flexible arm, a belt attached to one end the flexible arm, wherein the belt is adapted to releasably attach around a user's torso, a clamp attached to the distal end of the flexible arm, wherein the clamp is adapted to releasably hold a mobile electronic device; and at least one of A) a button and B) a lever is positioned on the belt and is coupled to at least one of 1) a wire, 2) a cable, and 3) a rod, wherein the at least one of 1) a wire, 2) a cable, and 3) a rod extends from the belt to the clamp and is coupled to at least one of 1) a mechanical actuator and II) an electromechanical actuator, wherein the at least one of 1) a mechanical actuator and II) an electromechanical actuator is attached to the clamp, wherein the at least one of 1) a mechanical actuator and II) an electromechanical actuator is adapted to press at least one button on the mobile electronic device when the at least one of A) a button and B) a lever is pressed.

2. The electronic device holding arm of claim 1, wherein the flexible arm is long enough to support the mobile electronic device above the level of the user's elbows.

3. The electronic device holding arm of claim 2, wherein the flexible arm is adapted to support a mobile electronic device weighing at least 3 ounces attached to the clamp at the distal end of the flexible arm without flexing.

4. The electronic device holding arm of claim 3, wherein the flexible arm is attached to the belt with a coupling means adapted to provide sufficient strength and stiffness to support a mobile electronic device weighing at least 3 ounces attached to the clamp at the distal end of the flexible arm.

5. The electronic device holding arm of claim 4, wherein the flexible arm is attached to the belt such that at least 4 inches of the flexible arm is fixed to the belt and runs tangentially to the belt without freedom to move away from the belt.

6. The electronic device holding arm of claim 4, wherein the flexible arm is a gooseneck arm, wherein the gooseneck arm is constructed of a series of members held in tension.

7. The electronic device holding arm of claim 4, wherein a flexible polymer sheet is attached to a portion of the belt and provides rigidity to the belt in the direction perpendicular to the axis of the belt.

8. The electronic device holding arm of claim 7, wherein the flexible polymer sheet is attached to the belt using at least one of A) sewing, B) adhesives, C) rivets, and D) plastic welding.

9. The electronic device holding arm of claim 8, wherein the flexible arm is attached to the belt on the portion of the belt that the plastic sheet is attached to, such that at least 4 inches of the flexible arm is fixed to the belt and runs tangentially to the belt without freedom to move away from the belt.

10. The electronic device holding arm of claim 9, wherein the flexible arm is a gooseneck arm, wherein the gooseneck arm is constructed of a series of members held in tension.

11. The electronic device holding arm of claim 10, wherein the flexible arm is capable of supporting a mobile electronic device in a position high enough that the top of the mobile electronic device is at least as high as the collar bone of the user.

12. The electronic device holding arm of claim 4, further comprising a battery attached to at least one of the belt and the clamp, wherein a wire connected to the battery can be selectively coupled to a charge connection port of the mobile electronic device.

* * * * *